US008708814B2

(12) United States Patent
Kane et al.

(10) Patent No.: US 8,708,814 B2
(45) Date of Patent: Apr. 29, 2014

(54) SYSTEM AND METHOD FOR PLAYING A GAME HAVING ONLINE AND OFFLINE ELEMENTS

(75) Inventors: Steven N. Kane, Brookline, MA (US); Dow Hardy, Marlborough, MA (US); Mark E. Herrmann, Wellesley, MA (US); Paul LaRocca, Westport, CT (US); Bijan Sabet, Sudbury, MA (US); Jason Yanowitz, Amherst, MA (US)

(73) Assignee: Scientific Games Holdings Limited, Ballymahon, Co. Longford (IE)

( * ) Notice: Subject to any disclaimer, the term of this patent is extended or adjusted under 35 U.S.C. 154(b) by 122 days.

(21) Appl. No.: 13/366,734

(22) Filed: Feb. 6, 2012

(65) Prior Publication Data

US 2012/0202577 A1 Aug. 9, 2012

Related U.S. Application Data

(60) Division of application No. 11/325,606, filed on Jan. 4, 2006, now Pat. No. 8,109,828, which is a continuation-in-part of application No. 11/001,775, filed on Nov. 30, 2004, now Pat. No. 8,038,529.

(60) Provisional application No. 60/641,248, filed on Jan. 4, 2005, provisional application No. 60/569,030, filed on May 7, 2004.

(51) Int. Cl.
*G07F 17/32* (2006.01)

(52) U.S. Cl.
USPC ..... 463/29; 463/16; 463/20; 463/25

(58) Field of Classification Search
USPC ..... 463/16, 20, 25, 29
See application file for complete search history.

(56) References Cited

U.S. PATENT DOCUMENTS 2,544,961 A 3/1951 Kemp
4,215,864 A 8/1980 Nichols (Continued)

FOREIGN PATENT DOCUMENTS

CA 2338080 9/2001
EP 1746550 1/2007

(Continued)

OTHER PUBLICATIONS

Rules of Pai Gow Poker. Casino City. Dec. 3, 2000. Online: http://web.archive.org/web/20001203170300/http://www.casinocity.com/rules-/paigow.htm.

(Continued)

*Primary Examiner* — Omkar Deodhar
(74) *Attorney, Agent, or Firm* — Dority & Manning, P.A.

(57) ABSTRACT

A system and method are provided for playing a game of chance. The game of chance may include, for example, a lottery-type or casino-based game. A partial result of the game of chance is revealed to a player in an offline portion of the game. The remaining portion of the result is revealed to the player in an online portion of the game. In one example, the online/offline game includes a slot machine game. In one example, the online/offline game includes a bingo game. In yet another example, the online/offline game includes a game of roulette. In one example, particular game features are associated with either the online or offline portions of the game. In this way, players are motivated to participate in both portions of the game, enhancing and prolonging the game experience.

8 Claims, 8 Drawing Sheets

(56) References Cited

U.S. PATENT DOCUMENTS 4,494,197 A 1/1985 Troy et al.
4,582,324 A 4/1986 Koza et al.
4,679,789 A 7/1987 Okada
4,689,742 A 8/1987 Troy et al.
4,725,079 A 2/1988 Koza et al.
4,764,666 A 8/1988 Bergeron
4,856,787 A 8/1989 Itkis
4,882,473 A 11/1989 Bergeron et al.
4,922,522 A 5/1990 Scanlon
5,158,293 A 10/1992 Mullins
5,324,035 A 6/1994 Morris et al.
5,351,970 A 10/1994 Fioretti
5,373,440 A 12/1994 Cohen
5,377,975 A 1/1995 Clapper, Jr.
5,398,932 A 3/1995 Eberhardt et al.
5,429,361 A 7/1995 Raven
5,445,391 A 8/1995 Gleason, Jr.
5,518,253 A 5/1996 Pocock et al.
5,569,082 A 10/1996 Kaye
5,586,937 A 12/1996 Menashe
5,611,729 A 3/1997 Schumacher
5,628,684 A 5/1997 Bouedec
5,645,485 A 7/1997 Clapper, Jr.
5,653,635 A 8/1997 Breeding
5,687,971 A 11/1997 Khaladkar
5,709,603 A 1/1998 Kaye
5,722,891 A 3/1998 Inoue
5,749,784 A 5/1998 Clapper, Jr.
5,768,382 A 6/1998 Schneier et al.
5,772,510 A * 6/1998 Roberts ..... 463/17
5,772,511 A 6/1998 Smeltzer
5,775,993 A 7/1998 Fentz et al.
5,779,549 A 7/1998 Walker et al.
5,788,573 A 8/1998 Baerlocher et al.
5,791,990 A 8/1998 Schroeder et al.
5,791,991 A 8/1998 Small
5,797,795 A 8/1998 Takemoto
5,810,664 A 9/1998 Clapper, Jr.
5,816,918 A 10/1998 Kelly et al.
5,823,873 A 10/1998 Moody
5,823,874 A 10/1998 Adams
5,830,069 A 11/1998 Soltesz et al.
5,848,932 A 12/1998 Adams
5,860,653 A 1/1999 Jacobs
5,871,398 A 2/1999 Schneier et al.
5,882,258 A 3/1999 Kelly et al.
5,887,906 A 3/1999 Sultan
5,928,082 A 7/1999 Clapper, Jr. et al.
5,944,606 A 8/1999 Gerow
5,954,582 A 9/1999 Zach et al.
5,980,385 A 11/1999 Clapper
5,996,997 A 12/1999 Kamille
6,007,426 A 12/1999 Kelly et al.
6,012,983 A 1/2000 Walker et al.
6,015,344 A 1/2000 Kelly et al.
6,024,640 A 2/2000 Walker et al.
6,028,920 A 2/2000 Carson
6,044,135 A 3/2000 Katz
6,048,269 A 4/2000 Burns et al.
6,056,289 A 5/2000 Clapper
6,059,289 A 5/2000 Vancura
6,077,163 A 6/2000 Walker et al.
6,106,393 A 8/2000 Sunaga et al.
6,113,495 A 9/2000 Walker et al.
6,146,272 A 11/2000 Walker et al.
6,152,823 A 11/2000 Lacoste et al.
6,159,097 A 12/2000 Gura
6,162,121 A 12/2000 Morro et al.
6,168,521 B1 1/2001 Luciano et al.
6,173,267 B1 1/2001 Cairns
6,179,711 B1 1/2001 Yoseloff
6,186,892 B1 2/2001 Frank et al.
6,193,608 B1 2/2001 Walker
6,203,011 B1 3/2001 Nulph et al.
6,203,427 B1 3/2001 Walker et al.
6,236,900 B1 5/2001 Geiger
6,241,606 B1 6/2001 Riendeau et al.
6,244,958 B1 6/2001 Acres et al.
6,251,017 B1 6/2001 Leason et al.
6,270,406 B1 8/2001 Sultan
6,273,817 B1 8/2001 Sultan
6,279,911 B1 8/2001 Cherry
6,280,325 B1 8/2001 Fisk
RE37,371 E 9/2001 Gerow
6,283,855 B1 9/2001 Bingham
6,287,197 B1 9/2001 Dickinson
6,302,793 B1 10/2001 Fertitta et al.
6,309,298 B1 10/2001 Gerow
6,311,976 B1 11/2001 Yoseloff et al.
6,312,334 B1 11/2001 Yoseloff
6,358,151 B1 3/2002 Enzminger et al.
6,364,765 B1 4/2002 Walker et al.
6,364,766 B1 4/2002 Anderson
6,368,214 B1 4/2002 Luciano
6,368,218 B2 4/2002 Angell, Jr.
6,371,852 B1 4/2002 Acres
6,375,567 B1 4/2002 Acres
6,390,921 B1 5/2002 Busch et al.
6,394,902 B1 5/2002 Glavich et al.
6,402,614 B1 6/2002 Schneier et al.
6,439,995 B1 8/2002 Hughs-Baird et al.
6,471,208 B2 10/2002 Yoseloff et al.
6,488,280 B1 12/2002 Katz et al.
6,514,144 B2 2/2003 Riendeau et al.
6,523,829 B1 2/2003 Walker et al.
6,527,175 B1 * 3/2003 Dietz et al. ..... 235/381
6,540,230 B1 4/2003 Walker et al.
6,565,084 B1 5/2003 Katz et al.
6,572,106 B2 6/2003 Alexoff et al.
6,572,107 B1 6/2003 Walker et al.
6,575,832 B1 6/2003 Manfredi et al.
6,582,307 B2 6/2003 Webb
6,582,310 B1 6/2003 Walker et al.
6,588,747 B1 7/2003 Seelig
6,595,854 B2 7/2003 Hughs-Baird
6,599,187 B2 7/2003 Gerow
6,599,192 B1 7/2003 Baerlocher et al.
6,607,439 B2 8/2003 Schneier et al.
6,612,501 B1 9/2003 Woll et al.
6,612,574 B1 9/2003 Cole et al.
6,619,660 B2 9/2003 Schaefer et al.
6,620,046 B2 9/2003 Rowe
6,625,578 B2 9/2003 Spaur et al.
6,645,074 B2 11/2003 Thomas et al.
6,645,075 B1 11/2003 Gatto
6,656,042 B2 12/2003 Reiss et al.
6,663,105 B1 12/2003 Sullivan et al.
6,676,126 B1 1/2004 Walker et al.
6,679,497 B2 1/2004 Walker et al.
6,681,995 B2 1/2004 Sukeda et al.
6,682,419 B2 1/2004 Webb et al.
D486,869 S 2/2004 Webb et al.
6,685,561 B2 2/2004 Anderson et al.
6,692,353 B2 2/2004 Walker et al.
6,705,944 B2 3/2004 Luciano
6,716,103 B1 4/2004 Eck et al.
6,719,631 B1 4/2004 Tulley et al.
6,729,956 B2 5/2004 Wolf et al.
6,733,385 B1 5/2004 Enzminger et al.
6,736,324 B2 5/2004 Behm
6,749,198 B2 6/2004 Katz et al.
6,761,633 B2 7/2004 Riendeau et al.
6,786,824 B2 9/2004 Cannon
6,811,484 B2 11/2004 Katz et al.
6,824,467 B2 11/2004 Schlottmann et al.
6,843,724 B2 1/2005 Walker et al.
6,852,031 B1 2/2005 Rowe et al.
6,855,052 B2 2/2005 Weiss et al.
6,866,584 B2 3/2005 Michaelson
6,896,619 B2 5/2005 Baltz
6,899,622 B2 5/2005 Lind et al.
6,910,968 B2 6/2005 Nassef et al.
6,913,534 B2 7/2005 DeFrees-Parrott
6,918,589 B2 7/2005 Thibault

(56) References Cited

U.S. PATENT DOCUMENTS

| | | | |
|---|---|---|---|
| 6,929,544 | B2 | 8/2005 | Osterer |
| 6,934,846 | B2 | 8/2005 | Szrek |
| 6,942,570 | B2 | 9/2005 | Schneier et al. |
| 6,969,319 | B2 | 11/2005 | Rowe et al. |
| 7,008,317 | B2 | 3/2006 | Cote et al. |
| 7,008,318 | B2 | 3/2006 | Schneier et al. |
| 7,024,375 | B2 | 4/2006 | Chau |
| 7,052,394 | B2 | 5/2006 | Walker et al. |
| 7,073,720 | B2 | 7/2006 | Behm |
| 7,094,149 | B2 | 8/2006 | Walker |
| 7,112,135 | B2 | 9/2006 | Anderson |
| 7,118,478 | B2 | 10/2006 | Fayter et al. |
| 7,163,459 | B2 | 1/2007 | Tanskanen et al. |
| 7,172,506 | B2 | 2/2007 | Baerlocher et al. |
| 7,179,168 | B1 | 2/2007 | Tulley et al. |
| 7,186,180 | B2 | 3/2007 | Lathrop |
| 7,213,811 | B2 | 5/2007 | Bozeman |
| 7,241,219 | B2 | 7/2007 | Walker |
| 7,275,990 | B2 | 10/2007 | Walker et al. |
| 7,285,045 | B2 | 10/2007 | Schneier et al. |
| 7,294,058 | B1 | 11/2007 | Slomiany et al. |
| 7,303,468 | B2 | 12/2007 | Schneier et al. |
| 7,303,470 | B2 | 12/2007 | George et al. |
| 7,311,599 | B2 | 12/2007 | Knapp |
| 7,357,393 | B2 | 4/2008 | Finocchio |
| 7,416,484 | B1 | 8/2008 | Nelson |
| 7,490,830 | B2 | 2/2009 | Mirandette |
| 2001/0034635 | A1 | 10/2001 | Winters |
| 2001/0046891 | A1 | 11/2001 | Acres |
| 2001/0049305 | A1 | 12/2001 | Riendeau et al. |
| 2002/0010015 | A1 | 1/2002 | Acres |
| 2002/0013167 | A1 | 1/2002 | Spaur et al. |
| 2002/0039923 | A1 | 4/2002 | Cannon et al. |
| 2002/0042300 | A2 | 4/2002 | Acres et al. |
| 2002/0052229 | A1 | 5/2002 | Halliburton et al. |
| 2002/0061778 | A1 | 5/2002 | Acres |
| 2002/0077173 | A1 | 6/2002 | Luciano et al. |
| 2002/0090986 | A1 | 7/2002 | Cote et al. |
| 2002/0090987 | A1 | 7/2002 | Walker et al. |
| 2002/0093190 | A1 | 7/2002 | Katz |
| 2002/0098882 | A1 | 7/2002 | Lind et al. |
| 2002/0107072 | A1 | 8/2002 | Giobbi et al. |
| 2002/0147040 | A1 | 10/2002 | Walker et al. |
| 2002/0152120 | A1 | 10/2002 | Howington et al. |
| 2002/0155885 | A1 | 10/2002 | Shvili |
| 2002/0169018 | A1 | 11/2002 | Schneier et al. |
| 2002/0187827 | A1 | 12/2002 | Blankstein |
| 2002/0193158 | A1 | 12/2002 | Weiss et al. |
| 2002/0198038 | A1 | 12/2002 | Adams |
| 2003/0013531 | A1 | 1/2003 | Rowe et al. |
| 2003/0027628 | A1 | 2/2003 | Luciano |
| 2003/0032473 | A1 | 2/2003 | Rowe et al. |
| 2003/0032476 | A1 | 2/2003 | Walker et al. |
| 2003/0045340 | A1 | 3/2003 | Roberts |
| 2003/0047869 | A1 | 3/2003 | Walker et al. |
| 2003/0060257 | A1 | 3/2003 | Katz et al. |
| 2003/0060261 | A1 | 3/2003 | Katz et al. |
| 2003/0069068 | A1 | 4/2003 | Kaminkow |
| 2003/0080508 | A1 | 5/2003 | Thibault |
| 2003/0102625 | A1 | 6/2003 | Katz et al. |
| 2003/0114217 | A1 | 6/2003 | Walker et al. |
| 2003/0119581 | A1 | 6/2003 | Cannon et al. |
| 2003/0139214 | A1 | 7/2003 | Wolf et al. |
| 2003/0155715 | A1 | 8/2003 | Walker et al. |
| 2003/0157977 | A1 | 8/2003 | Thomas et al. |
| 2003/0171986 | A1 | 9/2003 | Itkis |
| 2003/0176210 | A1 | 9/2003 | Vancura et al. |
| 2003/0176212 | A1 | 9/2003 | Schlottmann et al. |
| 2003/0184012 | A1 | 10/2003 | Green |
| 2003/0186739 | A1 | 10/2003 | Paulsen et al. |
| 2003/0195841 | A1 | 10/2003 | Ginsberg et al. |
| 2003/0199318 | A1 | 10/2003 | Nassef et al. |
| 2003/0218303 | A1 | 11/2003 | Walker et al. |
| 2003/0220138 | A1 | 11/2003 | Walker et al. |
| 2004/0025190 | A1 | 2/2004 | McCalla et al. |
| 2004/0036212 | A1 | 2/2004 | Walker et al. |
| 2004/0038723 | A1 | 2/2004 | Schneier et al. |
| 2004/0051240 | A1 | 3/2004 | Adams |
| 2004/0053683 | A1 | 3/2004 | Hartl et al. |
| 2004/0059445 | A1 | 3/2004 | Moore |
| 2004/0063484 | A1 | 4/2004 | Dreaper et al. |
| 2004/0092307 | A1 | 5/2004 | George et al. |
| 2004/0102238 | A1 | 5/2004 | Taylor |
| 2004/0102239 | A1 | 5/2004 | Samila |
| 2004/0127279 | A1 | 7/2004 | Gatto et al. |
| 2004/0133472 | A1 | 7/2004 | Leason et al. |
| 2004/0142741 | A1 | 7/2004 | Walker et al. |
| 2004/0147308 | A1 | 7/2004 | Walker et al. |
| 2004/0152504 | A1 | 8/2004 | Herrmann et al. |
| 2004/0152510 | A1 | 8/2004 | Herrmann |
| 2004/0180722 | A1 | 9/2004 | Giobbi et al. |
| 2004/0185930 | A1 | 9/2004 | Thomas et al. |
| 2004/0204222 | A1 | 10/2004 | Roberts |
| 2004/0214628 | A1 | 10/2004 | Boyd et al. |
| 2004/0229671 | A1 | 11/2004 | Stronach et al. |
| 2004/0229677 | A1 | 11/2004 | Gray et al. |
| 2004/0259629 | A1 | 12/2004 | Michaelson et al. |
| 2004/0259631 | A1 | 12/2004 | Katz et al. |
| 2005/0037841 | A1 | 2/2005 | de Waal |
| 2005/0049042 | A1 | 3/2005 | Walker et al. |
| 2005/0075158 | A1 | 4/2005 | Walker et al. |
| 2005/0090314 | A1 | 4/2005 | Nassef, Jr. et al. |
| 2005/0092839 | A1 | 5/2005 | Oram |
| 2005/0124407 | A1 | 6/2005 | Rowe et al. |
| 2005/0164779 | A1 | 7/2005 | Okuniewicz |
| 2005/0170881 | A1 | 8/2005 | Muskin |
| 2005/0187005 | A1 | 8/2005 | Rose et al. |
| 2005/0258596 | A1 | 11/2005 | Such |
| 2005/0282619 | A1 | 12/2005 | Vancura et al. |
| 2005/0282626 | A1 | 12/2005 | Manfredi et al. |
| 2005/0288088 | A1 | 12/2005 | Englman et al. |
| 2006/0025219 | A1 | 2/2006 | Nassef, Jr. et al. |
| 2006/0035696 | A1 | 2/2006 | Walker et al. |
| 2006/0036450 | A1 | 2/2006 | Nassef, Jr. et al. |
| 2006/0041586 | A1 | 2/2006 | Nassef, Jr. et al. |
| 2006/0068893 | A1 | 3/2006 | Jaffe et al. |
| 2006/0073884 | A1 | 4/2006 | Walker et al. |
| 2006/0089194 | A1 | 4/2006 | Joshi et al. |
| 2006/0148562 | A1 | 7/2006 | Walker et al. |
| 2006/0194631 | A1 | 8/2006 | Rowe et al. |
| 2006/0205511 | A1 | 9/2006 | Thomas et al. |
| 2006/0247035 | A1 | 11/2006 | Rowe et al. |
| 2007/0054729 | A1 | 3/2007 | Hornik et al. |
| 2007/0060261 | A1 | 3/2007 | Gomez et al. |
| 2007/0060274 | A1 | 3/2007 | Rowe et al. |
| 2007/0060317 | A1 | 3/2007 | Martin et al. |
| 2007/0060329 | A1 | 3/2007 | Martin et al. |
| 2007/0060330 | A1 | 3/2007 | Martin et al. |
| 2007/0060331 | A1 | 3/2007 | Martin et al. |
| 2007/0060369 | A1 | 3/2007 | Martin et al. |
| 2007/0087834 | A1 | 4/2007 | Moser et al. |
| 2007/0167216 | A1 | 7/2007 | Walker et al. |
| 2007/0173322 | A1 | 7/2007 | Swamy et al. |
| 2007/0265062 | A1 | 11/2007 | Thomas et al. |
| 2008/0032763 | A1 | 2/2008 | Giobbi |
| 2008/0039171 | A1 | 2/2008 | Slomiany et al. |
| 2008/0039173 | A1 | 2/2008 | Walther et al. |
| 2008/0287176 | A1 | 11/2008 | Bennett |

FOREIGN PATENT DOCUMENTS

| | | |
|---|---|---|
| EP | 1762990 | 3/2007 |
| EP | 1833014 | 9/2007 |
| WO | WO 91/06931 | 5/1991 |
| WO | WO 97/37737 | 10/1997 |
| WO | WO 99/10057 | 3/1999 |
| WO | WO 99/16519 | 4/1999 |
| WO | WO 00/43087 | 7/2000 |
| WO | WO 00/69535 | 11/2000 |
| WO | WO 01/14029 | 3/2001 |
| WO | WO 03/004118 | 1/2003 |
| WO | WO 03/061795 | 7/2003 |
| WO | WO 03/084625 | 10/2003 |
| WO | WO 03/089077 | 10/2003 |

(56) References Cited

FOREIGN PATENT DOCUMENTS

| | | |
|---|---|---|
| WO | WO 03/089082 | 10/2003 |
| WO | WO 2004/013820 | 2/2004 |
| WO | 2004/105902 | 9/2004 |
| WO | WO 2004/114073 | 12/2004 |
| WO | WO 2005/029279 | 3/2005 |
| WO | WO 2005/031666 | 4/2005 |
| WO | WO 2005/079242 | 9/2005 |
| WO | WO 2006/028820 | 3/2006 |
| WO | WO 2006/052469 | 5/2006 |
| WO | WO 2007/035618 | 3/2007 |
| WO | WO 2007/040707 | 4/2007 |
| WO | WO 2007/076321 | 7/2007 |
| WO | WO 2007/145999 | 12/2007 |
| WO | WO 2008/014334 | 1/2008 |
| WO | WO 2008/022083 | 2/2008 |
| WO | WO 2008/022084 | 2/2008 |

OTHER PUBLICATIONS

H.X. Mel and Doris Baker, Cryptography Decrypted, 2001 Addison Wesly, chapters 9 to 12.

Virginia Lottery games, downloaded from www.archive.org, Apr. 29, 2007.

Pop Cap Games, Bejeweled, Feb. 3, 2005, http://web.archive.org/web/20050203202244/http://www.go2share.net/game/be-jeweled/index.htm.

John Scarne, Scarne's Complete Guide to Gambling, 1961, Simon & Schuster, New York, chapter 4 on lotteries, pp. 125-126.

Wikipedia, "Wheel of Fortune (US Game Show)" Wikipedia, Nov. 13, 2007 <http://en.wikipedia.org/wiki/Wheel.sub.--of.sub.--Fortune.sub.--%28US- .sub.--game.sub.--show%29>.

New Jersey, State Of, "Wheel of Fortune" New Jersey Lottery, Nov. 13, 2007 <http://www.state.nj.us/lottery/instant/ig409.htm>.

New Jersey, State Of, "Lots O' Spots Bingo" New Jersey Lottery, Dec. 6, 2007 <http://www.state.nj.us/lottery/instant/ig340.htm>.

http://www.powerball.com/powerball/pb.sub.--howtoplay.asp, accessed Sep. 14, 2008, All.

Written opinion of the international searching authority (international application No. PCT/US07/76224).

Examiner's First report on patent application No. 2003298941.

Bejeweled Deluxe, Version 1.87, Developed and published by PopCap Games, Inc., www.popcap.com, http://www.popcap.com/faq/bejeweled/1033/pc/readme.html (1 of 8) Feb. 25, 2010 9:14:22 am.

David, Matthew, Online Games Development in Flash—A Brief History, Apr. 28, 2003, SitePoint, http://articles.sitepoint.com/print/flash-brief-history (1 of 6) Jun. 18, 2010 8:28:50 am.

* cited by examiner

SYSTEM AND METHOD FOR PLAYING A GAME HAVING ONLINE AND OFFLINE ELEMENTS

RELATED APPLICATIONS

The present application is a Divisional application of U.S. patent application Ser. No. 11/325,606, filed Jan. 4, 2006, which claims priority to U.S. Provisional Application Ser. No. 60/641,248, filed on Jan. 4, 2005, and is a Continuation-in-Part of U.S. patent application Ser. No. 11/001,775, filed on Nov. 30, 2004, which claims priority to U.S. Provisional Application Ser. No. 60/569,030, filed on May 7, 2004. Each of these applications are herein incorporated by reference in their entirety.

FIELD OF THE INVENTION

The field of the invention relates generally to lotteries and gaming, and more particularly, to systems for conducting lottery-based games or casino-based gaming.

BACKGROUND

There are many different types of games that are provided that involve the issuance of a lottery ticket to play a game of chance. Lottery tickets are sold through retailers using machines referred to as point of sale (POS) terminals. These tickets are generally printed at the POS terminal, and are usually issued for some lottery drawing to be performed at a later time. Examples of these types of lottery games of chance include traditional state lottery drawings and multi-state lottery drawings (e.g., PowerBall). Another type of lottery ticket, referred to in the art as instant lottery, includes a pre-printed scratch-type lottery ticket which includes a latex or similar coating that is scratched off by a purchaser (a player), revealing one or more game indicia and whether the player won the game or series of games as indicated on the ticket. The indication is generally "instant" in that the player knows, when they scratch off the ticket coating, whether or not they won the game.

There are many online games that can be played using a computer system coupled to a communication network (e.g., the Internet). These games may include traditional games of chance, games of skill, and casino-type games, among others.

Some conventional systems combine lottery-type games and online games. In one such system, a lottery ticket is sold to a player, who then plays a further game using a computer system. In such a game system, the ticket sold to a player includes a code which is correlated to a game seed stored in a computer system upon which a computer game is played. The computer game determines the correlated game seed, and this game seed is mapped to a series of predetermined game states that lead to a predetermined outcome. That is, the code stored on the ticket includes the outcome. However, the game seed itself is not indicative of any outcome or progress of the game.

In another type of conventional system, the code stored on the ticket is an encoded form of the lottery result, which is then revealed to the player at the end of play of an online game. This code also is not indicative of the outcome or progress of the game.

SUMMARY

New and more interesting game formats are needed for lottery and casino type games that keep players' interest and therefore result in continued and/or return players. According to one aspect of the present invention, a portion of a game is played offline, and another portion is played online. For instance, a scratch-type lottery ticket may be provided that, unlike conventional online lottery games, includes a partial outcome of a game on the ticket. In one example in the case where a scratch-off ticket is used, the player may scratch off a covering of a portion of the ticket to reveal a partial game result. Although, according to one embodiment, scratch-type lottery game pieces may be used, other types of game pieces (e.g., pull-tab, printed lottery, bingo tickets, keno tickets, etc.) may be used, and one or more methods may be used to reveal the partial result. These game pieces may be provided, for example, at a POS such as, for example, a lottery agent, casino, or other gaming establishment.

A remaining portion of the game result may be revealed to the player during a game played on a computer system. In one example, the computer system may be capable of downloading and playing one or more games over a communication network, such as the Internet. For instance, the remaining portion of the result may be revealed to the player during play of an online game.

In one embodiment, the offline portion of the game permits the player to progress through the game without revealing a final outcome. In another example, the offline portion of the game is configured to provide a partial outcome indicative of a possible win. This outcome indicative of a possible win may include an indication that the player is close to winning within a particular game instance. For example, in the case of a bingo game, the offline portion of the game may provide an indication that the player is close to obtaining a winning bingo pattern. This indication entices the player to continue to play the online portion of the game to obtain the final outcome of the game. Thus, a player is motivated to play both portions of the game, thereby prolonging the gaming experience. Although such an online/offline game format may be used to play a bingo game, it should be appreciated that other game types may implement such an online/offline game format.

In another embodiment of the present invention, a slot machine game is played in an online/offline format. In one example using a scratch-type ticket (or card) having a slot machine representation printed on the ticket, one or more scratchable areas are provided to the player for playing the offline portion of the game. These scratchable areas may be located in one or more slot locations presented on one or more reels of the slot machine representation. The player scratches one or more of the areas to reveal symbols printed on the ticket. These symbols may, when arranged in particular groups along pay lines of the slot machine, may provide a winning outcome. According to one embodiment of the present invention, one or more of the areas (e.g., slot locations) may not be revealed in the offline portion of the game. Rather, the player must play an online portion of the game to reveal the missing outcomes.

In another embodiment of the present invention, a bingo game is played in an online/offline format. In one example using a scratch-type ticket (or card) having a bingo game representation printed on the ticket, one or more scratchable areas are provided to the player for playing the offline portion of the game. Although these areas may be "scratchable," it should be appreciated that the indication may be hidden by other methods (e.g., by a pull-tab, by coding a result that can be decoded offline) or may not be hidden at all (e.g., by printing the indication of a potential win at the POS). In one embodiment, the bingo game played includes the well-known American bingo game format. However, it should be appreciated that any bingo game having any type of card or format may be used.

These scratchable areas may be located in one or more locations on one or more bingo cards, although it should be appreciated that other types of areas, either hidden or not, may be used to show indications associated with the offline portion of the game. In the example where scratchable areas are used, the player scratches one or more of the areas to reveal symbols printed on the ticket. These symbols may, when arranged in particular patterns on a bingo card, may provide a winning outcome.

According to one embodiment of the present invention, one or more of the areas (e.g., bingo card numbers) may not be revealed in the offline portion of the game. Rather, the player must play an online portion of the game to reveal the missing outcomes. In another example, all of the card numbers of one or more bingo cards are revealed in the offline portion of the game, and the player plays the online portion of the game to receive the called numbers, yielding the outcome of one or more bingo cards.

In another embodiment of the present invention, a roulette game is played in an online/offline format. In one example using a scratch-type ticket (or card) having a roulette game representation printed on the ticket, one or more scratchable areas are provided to the player for playing the offline portion of the game. These scratchable areas may be located in one or more locations on the roulette wheel representation and/or bet table. The player scratches one or more of the areas to reveal bets in bet areas on the bet table or the roulette wheel outcome printed on the ticket.

According to one embodiment of the present invention, one or more of the areas (e.g., the roulette wheel outcome) may not be revealed in the offline portion of the game. Rather, the player must play an online portion of the game to reveal the missing outcomes. In another example, bets on the bet table are revealed in the offline portion of the game, and the player plays the online portion of the game to receive the result of the spin of the roulette wheel, yielding the outcome of the individual bets. In another example, the printed card may have more than one bet table, each of which corresponds to a spin of a roulette wheel made in an online portion of the game. To this end, an online game may have a control that a player may select to cause the roulette wheel to spin and display the outcome of the spin.

According to another aspect of the present invention, a first game is played offline, and a second game is played online, both the first and second games being associated with the same ticket. For instance, this same ticket may permit a player to play a complete game offline, and play a separate game online. These first and second games, for example, may have independent outcomes. These games may, however, be the same or similar types of games (e.g., a slot machine game), same themes, etc. among the first and second games.

In another aspect of the present invention, standard offline games (e.g., scratch-based, pull-tab, printed lottery, bingo, keno, etc.) may be combined with an online game component. This is beneficial, as the interest in standard offline games may be increased by providing an additional online game component. For example, standard offline games may become "online" enabled by the payment of an additional fee. In one specific example, offline games are made online compatible at the point of ticket issuance (e.g., at a POS). For instance, a retailer may, upon payment of an additional fee, enable a ticket associated with an offline game to become online enabled. This may be accomplished, for example, at the POS by scanning or otherwise inputting a ticket identifier of an issued ticket and enabling an online game associated with the issued ticket.

In yet another aspect of the present invention, the online (or offline) portion may be in the form of a multiplier that, when combined with the offline (or online) result, causes an awarded prize to be increased. For instance, the prize value may be increased by a ratio reflected by the multiplier (e.g., a 2× multiplier may yield a doubling of a prize value). It should be appreciated that other aspects of the game can be included in the online or offline portions, and the invention is not limited to features used in the online or offline portions unless specifically recited in the claims.

According to one aspect of the present invention, a method for playing a game of chance is provided. The method comprises acts of issuing a ticket to a player, the ticket including an offline portion of a game including a portion of an outcome associated with the game, and providing for the player to obtain a remaining portion of the outcome from an online portion of the game. According to one embodiment of the invention, the act of issuing a ticket further comprises an act of providing a code printed on a surface of the ticket, wherein the code is used to gain security access to obtain results of the game of chance. According to another embodiment, the act of issuing a ticket includes an act of issuing at least one of a lottery ticket, a scratch ticket, and a pull-tab ticket. According to another embodiment, the act of providing further comprises an act of providing a computer-based game which the player plays to reveal the remaining portion of the outcome of the game. According to another embodiment, the act of providing a computer-based game further comprises an act of permitting access to the results of the game of chance by using the code as a decryption key to obtain the results.

According to one embodiment of the invention, the method further comprises an act of storing, on a server, the outcome of the game of chance. According to another embodiment, the method further comprises an act of storing, in a database of a computer system, a portion of a decryption key, the portion being used along with the code by the computer system to obtain the outcome. According to another embodiment, the act of providing includes an act of permitting access to a website to play the game. According to another embodiment, the game is at least one of a group comprising a slot machine game, a bingo game and a roulette game. According to another embodiment, the method further comprises an act of obtaining, from the database of the computer system, the portion of the decryption key based on an identifier printed on the ticket. According to another embodiment, the identifier is a serial number associated with the ticket.

According to one embodiment of the invention, the method further comprises an act of presenting, to the player, an interface in which the player is permitted to enter the code to obtain security access to the remaining portion of the outcome. According to another embodiment, the online portion of the game is a computer-based game involving a plurality of instances of an online game, and wherein the player plays the plurality of instances of the online game within an interface of the computer-based game. According to another embodiment, the ticket discloses the number of game instances of the game provided to the player. According to another embodiment, the player is permitted to play, with each one of the game instances, a plurality of bingo games. According to another embodiment, the player is permitted to play, with each one of the game instances, a plurality of roulette games. According to another embodiment, the player is permitted to play, with each one of the game instances, a plurality of slot machine games.

According to one embodiment of the invention, the ticket includes a plurality of areas indicating the portion of the outcome of the game. According to another embodiment, at least one of the plurality of areas is covered by a scratchable coating adapted to be removed by the player. According to another embodiment, the method further comprises an act of removing, by the player, the scratchable coating during the offline portion of the game. According to another embodiment, the outcome of the game is predetermined. According to another embodiment, the method further comprises an act of providing, in the online portion of the game, one or more reveals associated with the remaining portion of the outcome. According to another embodiment, the one or more reveals are predetermined. According to another embodiment, the one or more reveals are randomly determined by a client computer. According to another embodiment, the one or more reveals are stored in a database of a server.

According to one embodiment of the invention, the method further comprises an act of determining, based on the portion of the outcome and the remaining portion of the outcome, whether the player wins a prize. According to another embodiment, if it is determined that the player wins a prize, the method further comprises an act of awarding the prize to the player. According to another embodiment, the prize awarded to the player is at least one of cash, merchandise, and credit. According to another embodiment, an indication of the prize won by the player is stored in a database of a server, and is downloaded to a computer presenting the computer-based game to the player. According to another embodiment, the act of issuing a ticket includes an act of issuing at least one of a bingo ticket and a keno ticket.

According to one aspect of the present invention, a method for playing a game of chance is provided. The method comprises acts of issuing a ticket to a player, the ticket including an offline game including an outcome associated with the offline game, and providing for the player to play an online game having a separate outcome associated with the online game based on the issued ticket. According to another embodiment, the offline game is a separate game from the online game. According to another embodiment, the online game and offline game have separate respective outcomes. According to another embodiment, the offline game is at least one of a scratch-type, pull-tab, lottery, bingo, and keno games. According to another embodiment, the method further comprises an act of associating the online game with the offline game. According to another embodiment, the method further comprises an act of associating the at least one of the scratch-type, pull-tab, lottery, bingo, and keno games with the online game. According to another embodiment, the act of associating is performed at a point of sale (POS). According to another embodiment, the act of associating further comprises an act of associating the issued ticket with the online game.

Further features and advantages of the present invention as well as the structure and operation of various embodiments of the present invention are described in detail below with reference to the accompanying drawings. In the drawings, like reference numerals indicate like or functionally similar elements. Additionally, the left-most one or two digits of a reference numeral identifies the drawing in which the reference numeral first appears.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Various aspects of the present invention relate to an online/offline game format that may be implemented with a game of chance. Such games may be offered, for instance, through the lottery, casino, or other type of gaming establishment. According to one embodiment, a partial result of the game of chance is revealed to a player in an offline portion of the game. The remaining portion of the result is revealed to the player in an online portion of the game. The online/offline game may include various game formats, including, a slot machine game, a bingo game, a game of roulette, or any other type of game.

Also, as discussed, standard offline games (e.g., scratch-based, pull-tab, printed lottery, bingo, keno, etc.) may be combined with an online game component. This is beneficial, as the interest in standard offline games may be increased by providing an additional online game component. For example, standard offline games may become "online" enabled by the payment of an additional fee. Further, certain aspects of game play (e.g., the play of an additional game, the revealing of a prize multiplier, etc.) may be revealed in the online or offline portion of the game, as appropriate. Aspects of the present invention may be performed, for example, with an online gaming system as described in more detail below.

Figure 2:
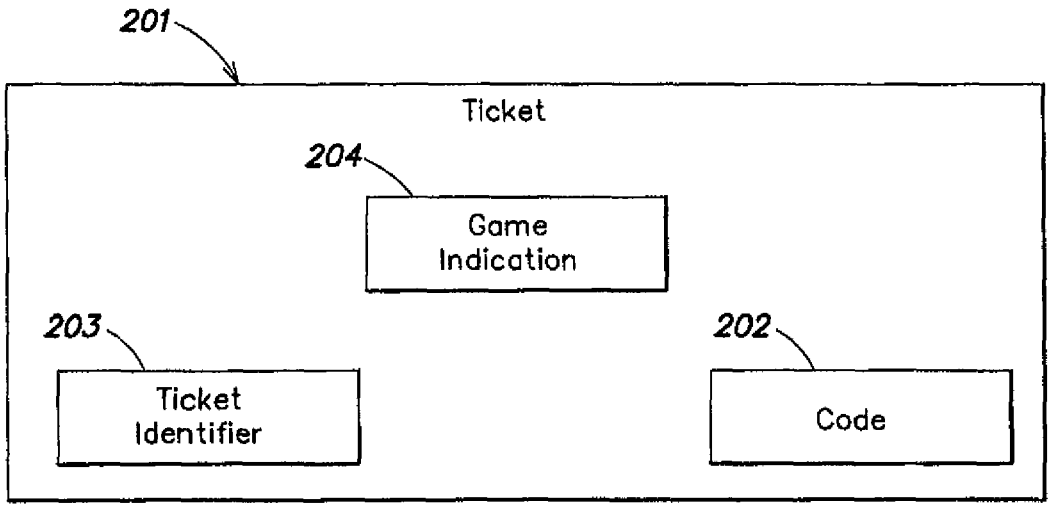
FIG. 2 is an example ticket that may be issued in association with a game according to one embodiment of the present invention.

FIG. 2 shows an example ticket 201 that may be issued to a player. The player may scratch a surface of the ticket (in the case of a scratch ticket) to reveal one or more indications. These indications may include, for example, a serial number of the ticket, an access code, or other indication (or combination thereof) that may be used to access the online game. Alternatively, the ticket may be a pull-tab ticket, printed ticket (e.g., by printing at the POS) or other ticket type suitable for presenting indications to a player.

As discussed above, the ticket may also include a partial outcome of a game, as discussed above. To this end, the ticket (or card) may have a number of scratchable or preprinted indications (e.g., as printed on a ticket at the POS) for play of the offline portion of the game. Remaining unrevealed areas printed on the card or other features of the game (e.g., a prize multiplier value) may be revealed during the online portion of the game.

The ticket may include other indications (e.g., a decryption key or portion thereof as described above that may be used to decrypt game results). Also, the ticket may indicate to a player the number of plays of a second game (e.g., as played by the player on a computer system). For instance, in the case of a slot machine game, the ticket may indicate the number of spins that a player may be awarded by the ticket. In the case of a slot machine, bingo, roulette, or other type game, the ticket may indicate the number of game instances (or plays) of the slot machine, bingo, roulette, or other type game that can be played by the player. In the bingo example described above, a card may have three bingo cards printed thereon, each card corresponding to a separate bingo draw.

In one embodiment, ticket 201 includes a code 202 printed on a surface of the ticket that provides access to outcomes (e.g., prizes) stored on the server. As discussed, code 202 may also include, as an optional feature to increase security, a key that may be used to decrypt the outcome. This outcome may be stored in a database stored on a server system. Ticket 201 may also include a ticket identifier 203 used to identify the ticket, and which may be used to identify the outcome associated with the ticket. Further, ticket 201 may include a game indication 204 that relates information relevant to a game played on a computer system. For example, there may also be stored, on the ticket, an identifier that indicates, to the player, the number of plays associated with an online game. In one example, a player purchases a ticket at a retailer or other POS location.

Figure 1:
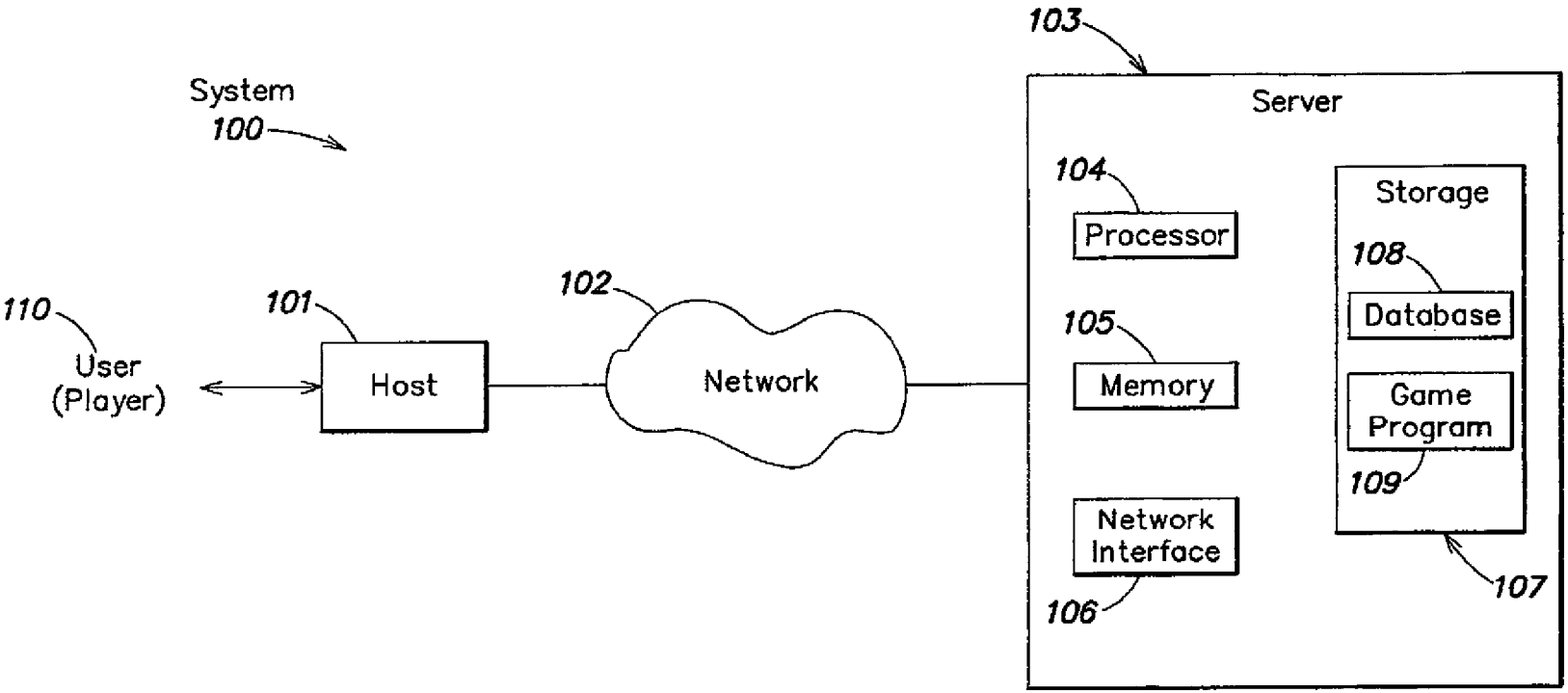
FIG. 1 is a block diagram of a system for conducting a game according to one embodiment of the present invention.

The player then proceeds to play a game on a computer system. FIG. 1 shows an example system 100 according to one embodiment of the invention upon which a game may be played. The user (a player) 110 plays a game through an interface of a host computer system (e.g. host 101). Host 101 may be any type of computer system that is capable of playing a game. The host may be, for example, a general-purpose computer system (e.g., a personal computer (PC)) that connects to a network (e.g., the Internet). Other general purpose computer system types (e.g., a PDA, a cell phone, set-top box, or other system type) may be used to play the game.

The computer system may be coupled to a server system 103 through one or more communication networks 102. The server may provide a game program 109 that is executed by host 101 for playing the game. More particularly, game program 109, when executed, may provide an online game that can be played by a user through an interface associated with host 101. This online game may be, for example, a video slot machine, blackjack, or other online or casino-type game.

The game program may be stored, for example, in a computer-readable medium (e.g., a memory, storage, or other media) associated with server 103 that provides game programs. For instance, the game program may be stored on a web server and downloaded to a client computer over the Internet. Game program 109 may be one of a number of game programs associated with an online game experience. Different game programs may be selectively downloaded to the client, based on the type of game ticket issued, the game selected for play by the user, the type of client used, or other criteria.

Server 103 may also be a general-purpose computer system, or any other type of computer system capable of authenticating tickets, providing game programs, and performing other game-related functions. Further, it should be appreciated that various game functions may be performed by one or more server systems. Server 103 generally includes a processor 104 for executing server-based game functions. Server 103 may also include a memory 105 for storing data associated with game programs. Server 103 may also include one or more network interfaces 106 that couple server 103 to network 102, which permit server 103 to communicate with one or more hosts. Further, server 103 may include one or more storage entities 107, including disks or other media for storing data. In one embodiment, storage 107 is adapted to store one or more game programs 109 as discussed above. Server 103 may have any number or type of processor that executes an operating system and one or more application programs. In one embodiment, server 103 provides web server content to one or more clients for the purpose of accessing and playing the game.

Server 103 may also include a database 108 that is adapted to store one or more outcomes associated with a ticket or other gaming piece. As discussed, the outcome may be indexed using an identifier of the ticket.

Figure 3:
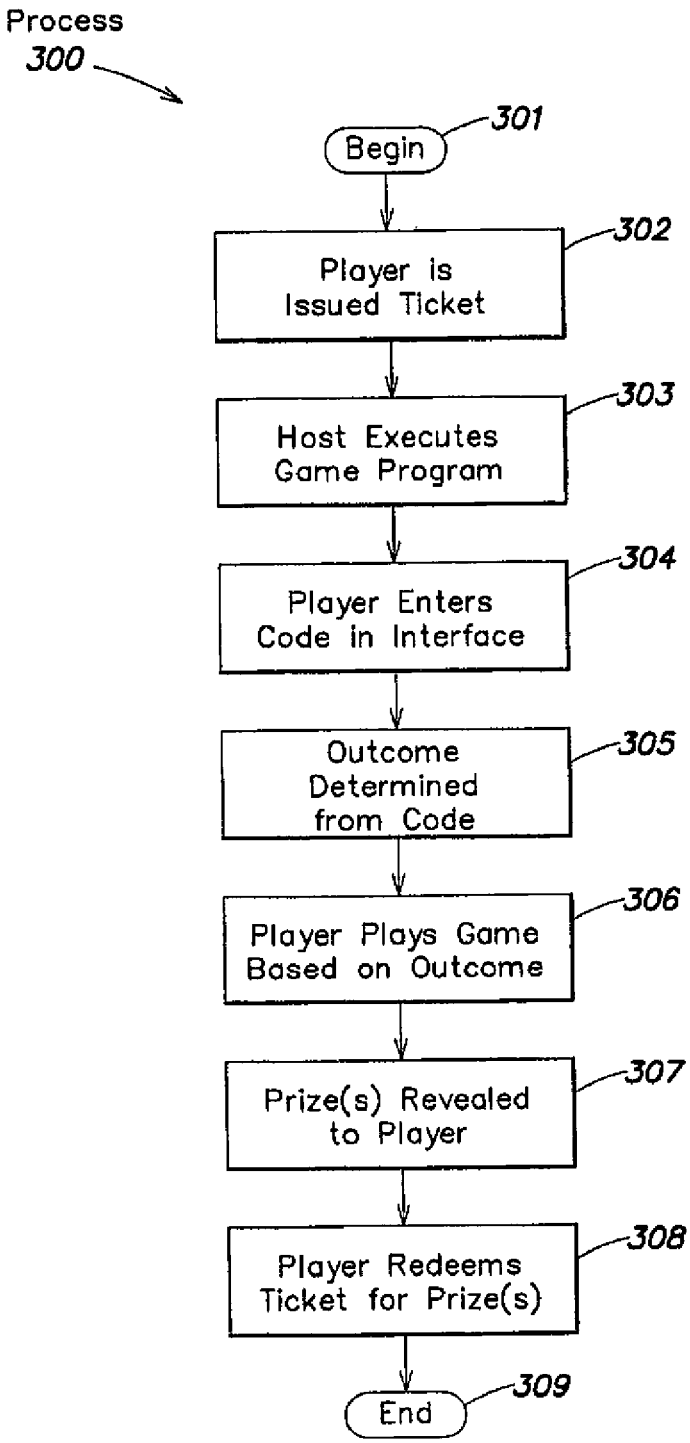
FIG. 3 is a flow chart of a process for conducting a game according to one embodiment of the present invention.

FIG. 3 shows one example process for conducting a game according to one embodiment of the present invention. At block 301, process 300 begins. At block 302, a player is issued a ticket, and the player plays the offline portion of the game. As discussed, a player may purchase a ticket at a retailer or other POS location. At some later time and/or location, the player may play an online game on one or more computer systems (e.g., a PC or other computer system capable of playing games). For instance, at block 303, a host computer system (e.g., host 101) executes a game program. The game program may be, for example, an online game that includes one or more components downloaded over a communication network (e.g., the Internet).

The ticket may include one or more indications. In one example, the ticket may include one or more elements of an offline game as discussed above. The elements may be any type of items that make up the game. For instance, the elements may be bingo balls, slot reel elements, alphabet tiles, numbers, etc. These items may be printed on a surface of the ticket (either preprinted or printed at the POS) and presented to the player during the offline portion of the game. Also, the ticket may include a code which is used to access the outcome of a game. This code may be printed on a face of the ticket as discussed above with reference to FIG. 2. In one example system, the player accesses a website that includes an interface in which the player may enter the code at block 304.

This interface may be, for example, used to access the game, or may be any other interface (e.g., an interface used to access a download website used for downloading game software (e.g., game program 109)). The interface may be programmed in one or more computer languages (e.g., an HTML, Java, Macromedia Flash, or other type interface) and may include a text entry box in which the player can input the code. The interface may include other ways of entering a code or other parameter (e.g., a glyph printed on a ticket) that allows the user to gain access to the game. It should be appreciated that the invention is not limited to any particular method for entering the code, or any format of the code, and that any type of code or method of entry may be used.

The player enters the code, and an outcome is determined at block 305 based on the code. More particularly, there may be a mapping between the code printed on the ticket and an outcome stored on the server. This code may be stored, for example, in a database structure stored in database 108 of the server. Database 108 may be, for example, a relational database, object database, flat file database, or other organizational entities used to store and maintain data. Further a listing of winning codes may be furnished to an organization that provides the game (such as, for example, a state-run lottery commission). The code may, as discussed above, include an optional decryption key that decrypts an entry stored on the server. This entry may indicate one or more outcomes of game instances.

The outcome of the game is then used by the online game to determine play of the game by the player at block 306. For instance, if the stored outcome is "Win $50," the online game may present an outcome to the player that indicates that the player won a $50 prize. This presentation may be in the form of one or more reveals presented to the player while playing the online game at block 307. The presentation may be progressive, in that the ultimate outcome (e.g., "Win $50") is achieved through a set of reveals or progressions through the online game. For example, in the case where a slot machine game is played wherein a series of spins are used to reveal slot machine entries, such reveal outcomes of each spin may be stored on the server.

As discussed, prizes may be distributed over game instances and/or items (or more generally, win opportunities) to maximize game interest and to entice the player to play each game instance associated with a particular ticket. For example, one approach may include providing to the player an early (relative in the series of game instances) indication of winning to keep the player interested.

As the player plays more game instances, the magnitude of the prizes may be adjusted such that a level of game "drama" is increased. That is, prize values are adjusted among later game instances to provide relatively higher prize values in later games. Other approaches/distributions may be provided for increasing or maintaining game interest.

Once played, the player may redeem the ticket at the point of sale or other redemption location at block 308. Alternatively, the player may be permitted to redeem the ticket without playing the game, either the online or offline portions or both. Redemption may be permitted, for example, after a predetermined time. For instance, the player may be permitted to redeem a ticket after a set time (e.g., 10 PM), a particular time period after ticket purchase (e.g., 24 hours) or other absolute or relative time. This may be the case for a Keno or lottery-based system, where a Keno or lottery result is made available at a set time after ticket purchase. Alternatively, tickets may be redeemed immediately after purchase. At block 309, process 300 ends.

Payouts may be determined by a pay table associated with the game. The number of tickets may be determined a priori, and a pay table that determines payouts may be allocated to the tickets. This allocation may be determined, for example, by shuffling the pay table and allocating results to tickets. The following is an example of a pay table that may be used with a game according to one embodiment of the invention:

Number of Tickets Issued: 2000

Ticket Price: $5

TABLE 1

Example Payout Table

| Number of Tickets | Payout |
|---|---|
| 1 | $100 |
| 700 | $ 10 |
| 500 | $ 5 |
| 100 | $ 1 |
| 600 | $ 0 |

Game Operator Return: $300 (3%)—Expenses

As shown in the example above, a certain number of tickets may be allocated as winning tickets having a particular payout (e.g., an outcome). Some tickets may have no payout associated with them, and some may only have a nominal payout (e.g., a small award amount, free ticket, etc.). A small number of tickets may include a large payout as compared to the magnitude of other payouts. It should be appreciated, however, that payouts are not limited to money, but other types of prizes may be awarded including merchandise, credit, loyalty points or any other representation of value.

The odds of winning may be the type of odds experienced in actual (rather than computer-based) games. Alternatively, the odds of winning may not necessarily be "natural" odds of winning any particular type of game, but rather, the odds may be adjusted to obtain the outcome desired (e.g., by the gaming operator). The odds of winning, number of winning tickets, amount of payout per ticket, or other payout parameter may be any amount or number, and the invention is not limited to any particular odds of winning, number of winning tickets, payout amount or type of payout. However, according to one embodiment, the overall odds of winning, amount and type of payout, etc. may be similar to a game previously approved by regulators (e.g., scratch ticket games, Keno, bingo, etc.) so that the use of an additional game to display an outcome associated with the previously-approved game is scrutinized much less by regulators, and as a result, the approval of the additional game is less burdensome. To this end, a system associated with the previously-approved game may provide ticket and outcome information to a system conducting an online game (e.g. server 103).

The code stored on the server (e.g., server 103) may be used to determine game play as played on the computer system. For instance, the game outcome may be "Win $50." In the case of a slot machine-type game, the ticket may indicate that the player receives 10 spins of the slot machine. The outcome of each spin may be predetermined, and the game may retrieve information from the server indicating a predetermined sequence of game play as discussed above. In the case of a slot machine-type game, the predetermined sequence may indicate the winnings associated with each of the spins/reveals. Intermediate reveal outcomes to be displayed to the player during the single instance of the game may be stored on the server and retrieved when necessary. These outcomes may be revealed to the player at different points during play of the game. For instance, outcomes may be revealed when a player performs an action (e.g., draws certain cards, spins a slot machine, spins a roulette wheel, etc.).

In another example, only the overall outcome is predetermined (e.g., the total winning associated with the ticket), and the sequence of game play may be determined when the game is played. In the example above where the player is indicated as winning $50 over 10 spins, the $50 winnings (and any intermediate losses) may be allocated to the player at any point over the 10 spins. In the case of the poker game, winnings may be allocated across game instances. In a further example, winnings may be allocated across items collected (e.g., spins) while playing the poker game. Because the number of items collected may vary depending on the skill of the player, the distribution of prizes among collected items may be determined during game play by the game playing system. Thus, according to one embodiment, the player's skill (or lack thereof) does not affect the overall outcome of the game. In one example, the player may be provided a single spin prior to play of the poker game.

This allocation may be determined by the server, the game software executing on the client, or a combination thereof. Further, the game play may be randomized in that a further play using the same ticket may yield a different sequence of game states leading to the same outcome. For example, in the case of a slot machine game as described above, a player may be indicated as winning $50, but the sequence by which the player attains the $50 winning outcome may be different depending on various factors. Such factors may include a randomization function that determines results of individual game plays (e.g., in the case of a series of "spins," the result of each spin), or some other function. The series of intermediate outcomes may be stored in a database associated with the server as discussed above with respect to game outcomes. Also, the outcomes may be adjusted using a formula or rulebased approach during execution of the game to increase the game drama and heighten the game playing experience.

According to another aspect of the present invention, a player may purchase a ticket at a POS (e.g., a convenience store) and the indication of a win/no win condition of the ticket is revealed on a different medium. For instance, a player purchases a scratch ticket in a convenience or other type of store. The prize that the player wins is not revealed on the scratch card itself, but rather the prize is revealed through another medium (e.g., on a home computer system, PDA, cell phone, etc.).

For instance, as discussed above, the player may be presented another game (e.g., a slot machine, bingo game, roulette game, or other game as described above) that reveals at least a portion of the outcome (e.g., a prize, game result, or other outcome). The underlying prizes available via the reveals may be predetermined, in that the ultimate outcome and any intermediate outcomes of the game may be stored in one or more systems and revealed during play of an online game. The scratch ticket may reveal different numbers of plays (e.g., pulls in the case of a slot-machine type game, or game instances of a bingo game) the player receives during the online portion of the game.

In one aspect of the present invention, the ticket includes authentication information that is used to obtain the reveals. In one example, the scratch ticket contains a secret key which is used to decrypt the results that are revealed to the player. That is, according to one aspect, it is impossible to determine if and what a particular ticket wins without having possession of the ticket (and therefore the secret key). In another example, the scratch ticket could contain only a portion of the secret key. The other portion of the key may be stored, for example, on a server and retrieved from a database (e.g., file, relational database, etc.) based on, for example, the serial number of the card. Mappings of serial numbers of tickets to encrypted results can be provided to the lottery provider for additional audit control.

Figure 4:
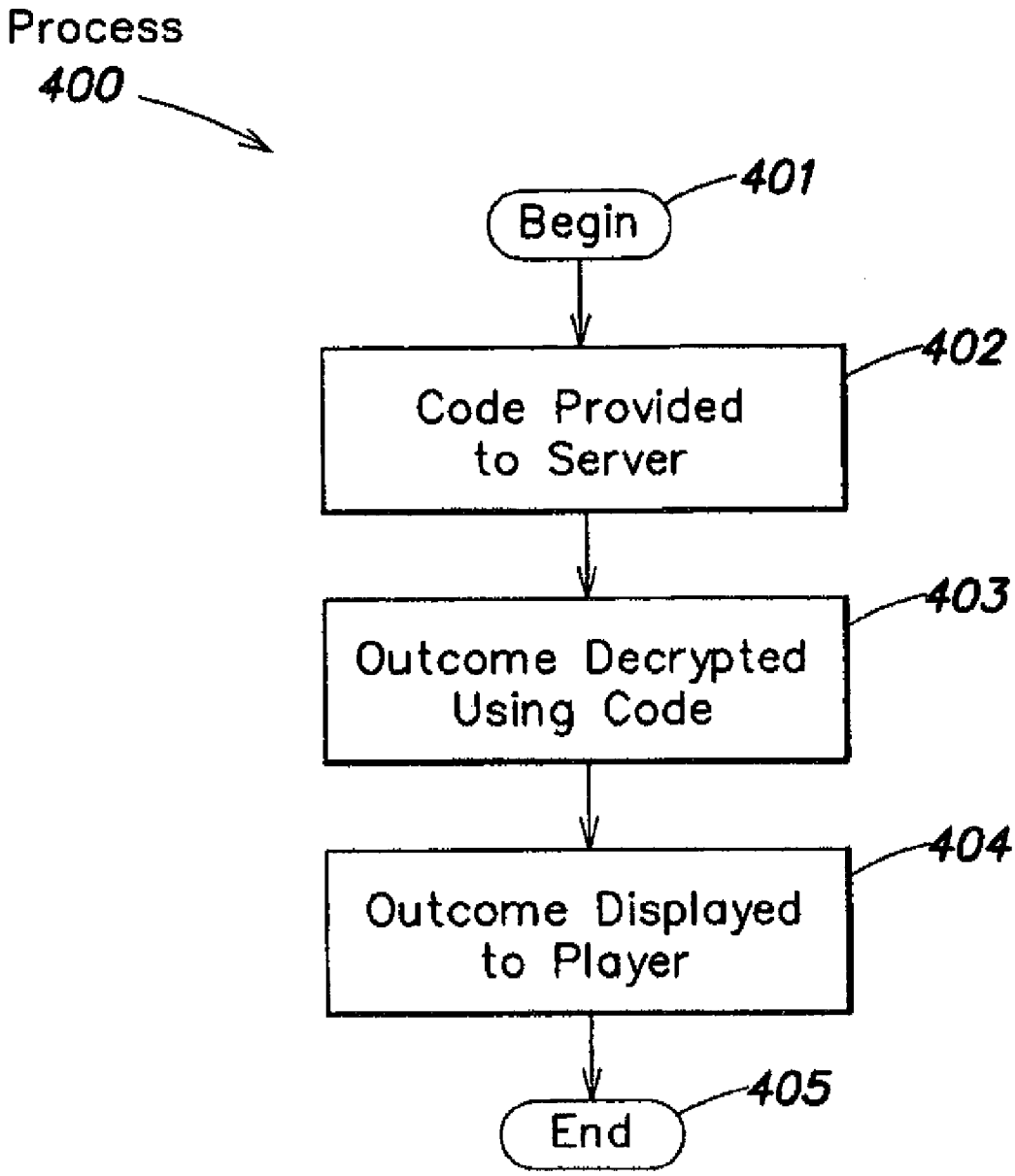
FIG. 4 is a flow chart of a process for conducting a game according to another embodiment of the present invention.

A process for performing secure access to outcomes is shown in FIG. 4. At block 401, process 400 begins. A server (e.g., server 103) may store a number of outcomes in encrypted form, each of which outcomes can be accessed by a respective code. These outcomes may be encrypted, for example, using any encryption method (e.g., symmetric, asymmetric encryption) as is known in the art. At block 402, a code is provided to the server (e.g., server 103).

This code may be, for example, a secret code (e.g., a symmetric key, a private key) printed on a ticket and provided to the server by a user through an interface of a computer system as discussed above. The received code may be transmitted between systems using a secure transmission method (e.g., SSL) as is known in the art. The received code is used at block 403 to decrypt the outcome stored on the server. This code may be any decryption key type that may be used to decode data, and may be of any format or length. The decrypted outcome may then be presented to a player at block 405. The outcome may be displayed using any method. For example, as discussed above, the outcome may be presented through one or more reveals presented to the player during play of an online game. At block 405, process 400 ends.

Another aspect of the present invention relates to a lottery-based software game that can be played over a network, such as the Internet. According to one embodiment, the system includes a purchase of a scratch-based or printed ticket by a player at a point of sale (POS). A POS may be, for example, a place at which lottery tickets may be sold, including convenience stores or other locations where lottery products are provided. In an alternative system provided at a casino or other gaming establishment, a ticket may be sold to a player at the casino for play within the casino, or at a later time outside of the casino provided any winnings are redeemed within the casino or other legal gambling jurisdiction.

The player receives the ticket at the POS or other location, and proceeds to play a computer-based game at another location to reveal a result (or outcome) of the game. The computer-based game may be, for example, a casino-type game (e.g. slot machine, bingo, roulette) or other type of game, including amusement games or games of chance. In the case of the scratch or printed ticket, the overall result is not apparent to the player until the player plays the computer-based game. This game may be, for example, a software program that is downloaded and played over the Internet. Alternatively, other ways of accessing the online portion of the game may be used (e.g., PDA, cell phone or other method).

The ticket includes a code by which a player gains access to a result stored on a server that stores ticket information and results associated with each ticket. Such information may be predetermined at the time of ticket sale, or the results may not be known until a later time, after the ticket is issued to the player (e.g., in the case of a Keno, bingo, or other drawing-based system). According to one embodiment, the code is an access key (or a portion thereof) that is used to access the result stored on the server. Further, the result (stored in the server) may be encrypted. For example, the code may be a private key or a symmetric key. The key may be transmitted by a client computer system to the server for the purpose of decrypting the result using SSL or any other secure method.

Because the decryption key is stored on the ticket, the gaming system is safer, as a breach of security of either the tickets or the server does not provide access to result information. More particularly, access to the lottery ticket database may not be accomplished without the ticket (used to decrypt the result). Further, the tickets may not be correlated to results without the lottery ticket database (because the results are stored in the database, not on the tickets).

In another example of the system, a portion of the key used to decrypt results of the game is stored on the ticket, and another portion is stored in the database of the server. In this manner, it is assured that possession of either portion of the key may not compromise the results.

However, it should be appreciated that the system does not require SSL or any other encryption/decryption method, a decryption key on the ticket, or the stored result on the server to be encrypted. Rather, the game can be implemented with or without these features. That is, access to the outcome stored at the server may be performed using only the serial number or other ticket identifier printed on the ticket.

The scratch-based or printed ticket also includes a second serial number or other identifier (e.g., an access code) in addition to the serial number or other identifier which is correlated to results on the server. A ticket may include both a serial number and a ticket identifier used by the system. According to one embodiment, it is appreciated that there may be security issues with using the serial number of a printed ticket (as printed on the ticket) to correlate to win outcomes. That is, the lottery provider may not allow any entity outside of the lottery system to have the ability to correlate outcomes to serial numbers. To this end, another identifier (e.g., a separate ticket identifier or access code) may be provided on a ticket to allow the system to index into an outcome database.

In one example system that works in association with a lottery system, outcomes for a game may be predetermined to comply with lottery rules. In this case, outcomes are predetermined and stored in a database. In an alternative environment where results are not permitted to be predetermined (e.g., in a casino), but rather are determined at a later time (e.g., by a drawing or other method), a ticket issued by a system in such an environment may have an associated drawing time when a game may be played. In the case where the online game system is driven by a Keno game result, each ticket may be associated with a set of numbers in the Keno game, and the result of the Keno game is provided as the result for the online game. In one example, a computer system automatically picks numbers associated with the ticket at the point when the ticket is issued. Thereafter, when the Keno game occurs, the result of the Keno draw is provided to an online game system, which translates the Keno result to a game experience within another game (e.g., poker game, slot machine, etc.). It should be appreciated, however, that although the game of Keno may be used to drive an online game experience, other games (e.g., bingo) may be used.

The server (e.g., server 103) may be capable of accepting, from the user, an input of the serial number and decryption key, and in response, providing the results associated with the particular ticket. The result or outcome of the game may be displayed to the player in an interface of the computer system (e.g., a client computer system such as a personal computer (PC)) used to play the computer-based game. For example, the outcome of a series of plays associated with the ticket may be stored in the server, and provided to the client, and the series of outcomes may be presented to the player during play of the computer-based game.

In a specific example of an online/offline game that may be played in association with a ticket having a corresponding result determined at a later time (e.g., by a drawing or other method), there may be difficulty in creating content for the offline portion of the game, as the overall result of the game has not been determined at the time of ticket printing. More particularly, because the outcome is not predetermined, the offline portion of the game needs to be able to yield any result that occurs within the paytable for the game. According to one embodiment, it is realized that the offline portion of the game may include a prize multiplier that is used to increase any prize amount won in the online portion of the game. Because the multiplier does not directly determine the win/loss result, it may be more easily figured into the paytable at a later time (e.g., when the drawing occurs). For instance, the ticket may include a scratchable area, that when revealed to the player, indicates that any prize awarded in the online game should be multiplied according to the indication printed on the ticket. This indication may be, for example, an encoded picture (e.g., a picture of three cherries corresponds to a 3× multiplier) that relates to a prize multiplier value.

In another embodiment of the system, a payout of the ticket may be encoded on the ticket. For instance, if the ticket is a $5 winner, the amount of the win may be encoded on the ticket. In the case of the casino-based version of the system, the payout may not be stored on the ticket (as the payout is not predetermined), but rather the purchase price of the ticket may be stored on the ticket, or some other identifier of the ticket.

Figure 5:
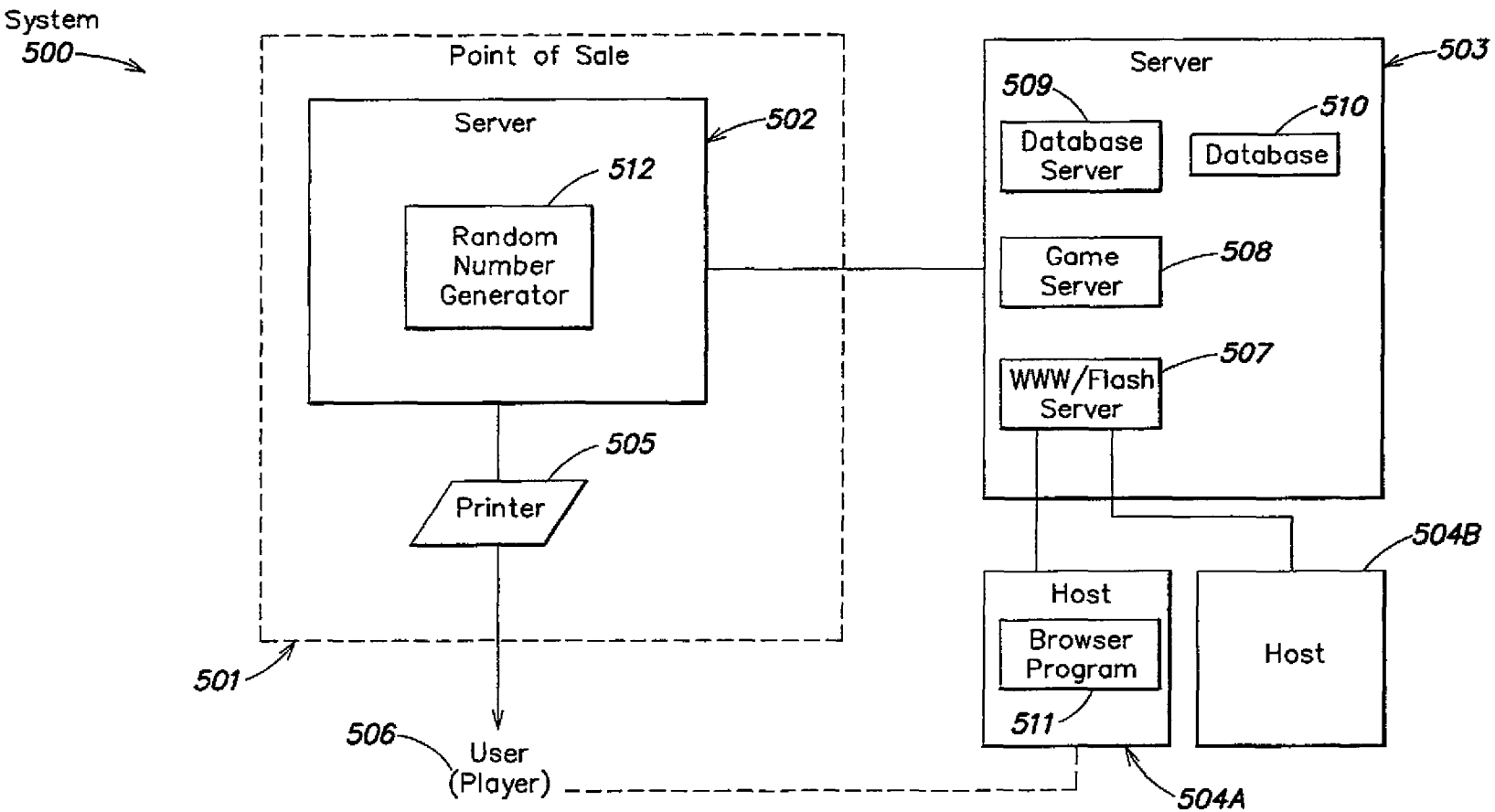
FIG. 5 is a system for conducting a game according to according to one embodiment of the present invention.

As shown in FIG. 5, a system 500 may be provided having more than one server. For instance, a server 502 provided at the point of sale 501 is primarily responsible with issuing tickets to a user/player 506. To this end, server 502 may issue preprinted tickets or may issue tickets printed from an associated printer 505. Such tickets may include one or more identifiers as discussed above with reference to FIG. 2. As discussed, another system such as a Keno or lottery-based system may be used to provide results to an online game system.

In one version of system 500, the win/loss determination of a ticket may be driven by a later-occurring drawing. For example, a Keno-based, bingo-based, or other type lottery draw system may be used wherein the outcome of a particular game is not known until a future time (e.g., when a drawing occurs). In this case, the ticket identifier stored on the ticket may be an access code generated from ticket identifiers in the Keno-based system (e.g., by an intermediate system or the Keno server itself that can translate a Keno ticket identifier into another type of identifier).

Generation of an identifier separate from the Keno ticket identifier may be necessary for security reasons relating to the Keno system. More particularly, access to the Keno ticket identifiers may not be permitted by the system (e.g., the Keno server). In one example, a Keno system translates Keno ticket identifiers into access codes and results that are stored on the game server (e.g., server 503). Thereafter, clients (e.g., hosts 504A, 504B) access results stored on the server based on their respective access codes.

As discussed above, one or more hosts 504A, 504B (e.g., general purpose computer systems) may communicate with a server 503 over a network for the purpose of conducting a game. In one example, a host 504A renders a browser window by executing a browser program (e.g., the Internet Explorer browser program available from the Microsoft Corporation). A user/player 506 enters a URL address specified by an issued ticket in a window of the browser interface, and is directed to a website associated with server 503. This website may be rendered by, for example, a WWW server process (e.g., server 507) associated with server 503.

Player 506 may be instructed to enter an access code (and/or any other required information) to access one or more games in an interface presented through the browser. As discussed, server 503 may validate the received access code, and provide any results stored in a database associated with server 510. Once validated by server 503, the user may be permitted to play one or more games. These game may be, for example, be programmed using one or more programming languages (e.g., Macromedia Flash) and may be downloaded to host 504A and executed.

According to one aspect of the present invention, it may be beneficial to provide a game program that may be downloaded quickly to a client and played by a player without requiring any installation procedure, requiring operator (player) intervention, or delays in downloading large files. To this end, the game program may be programmed in a language supported by a majority of game playing systems (e.g., Macromedia Flash, etc.), and played without the need for downloading and installing large software components. In one specific example, the game program may execute within a browser program (e.g., the Microsoft Explorer browser program) window. In this manner, less-sophisticated players who have difficulty using computers and/or installing software may not be prohibited from playing the game. Of course, it should be appreciated that any programming method may be used that requires or does not require any installation procedure, and the invention is not limited to any particular programming method.

Also, outcomes associated with any games may be downloaded prior to game play. As discussed, examples of games include those that may be of the lottery-type (e.g., having a predetermined outcome) and those that are casino-based (e.g., having an outcome that is not determined at the time of sale of the ticket). In the case where a later drawing affects an outcome, a player may not be permitted to play the game until the drawing occurs (and until results are available at server 503). In the case of a drawing that affects outcomes, drawing results can be communicated from server 502 to server 503. In addition, server 502 may maintain a mapping from a ticket identifier (e.g., a serial number) to an access code provided on the ticket, and provide a mapping of outcome to access code when the drawing occurs. As discussed, such outcome information may be maintained in a database 510 associated with server 503 and may be accessed through a database server process 509.

As discussed, the payout of the lottery ticket may be displayed to a player in a number of ways. For instance, the payout of the ticket may be presented to the player through one or more reveals presented to a player during one or more plays of an online game.

For instance, in the case of a slot machine game, a player may be permitted, with the issue of a single scratch or printed ticket, a series of spins of the slot machine. The slot machine may, as the result of each of the spins, produce results that contribute to the overall payout to the player. For instance, after a single spin, a player may be presented an indication that he/she has won $5. The payout to the player as provided from the server database may be, for the series of spins, $50 overall, with particular outcomes for each spin. Additional spin results may provide the additional $45 that the player will receive. Additional spins may add, subtract, or have no effect on the contribution to the outcome of the game. These results of each spin of the slot machine game may be stored in the database of the server indexed by the ticket identifier, or may be randomly determined by the game program that renders the game. Further, as discussed above, the results of each spin may be "scripted" such that the game experience is more exciting to the player.

For example, in the case where the results of each spin are stored on the server, the series of results may be downloaded to the client at the beginning of the game as a series of entries, and the client may reveal each result as the player progresses through the series of spins. In the random method, results for each individual spin are not predetermined, but rather are determined by the client in a random manner. For instance, the actual outcomes of each spin may be randomly chosen among the possible combination of outcomes that may produce the required payout. In either case, the outcomes for each spin of the slot machine game is not stored on the ticket, but rather is stored at the server and downloaded just prior or during game play, or is determined randomly by the client. Alternatively, the client may determine the game experience based on a predetermined set of rules or formulas that, when an overall outcome is provided, allows the client to determine intermediate outcomes in a dynamic way.

Because the game play and outcome are scripted, a player may also not play the game (and possible secondary games) to actually win. A player may purchase a ticket, wait until the ticket may be redeemed, and go to a POS to find out (and if necessary, receive) his/her winnings. A ticket may be allowed to be redeemed after a predetermined period of time after the drawing independent of whether the player has played the game. A ticket may be able to be redeemed after a predetermined period of time, from almost immediately to seconds to days or any predetermined time. For tickets with results dependent upon results of a particular Keno game or other event, the ticket may not be redeemed until after the event has passed.

Finally, after play of the online game, the player is permitted to validate the ticket at any POS location (e.g., 501 (for example, a lottery agent, casino, or other gaming establishment) to redeem his/her winnings as indicated during the online portion of the game. According to one embodiment, players are permitted to redeem their winnings only after playing the online portion of the game. The player, by playing the online portion of the game, sets status information at the server (e.g., server 503). When the player attempts to redeem the ticket at the POS (e.g., 501), the status information may be checked, and the player is permitted to redeem his/her winnings. To this end, server 503 may communicate information back to server 502 relating to game play.

For instance, server 503 may collect information that indicates the sequence of game play performed at the client, and other player tracking information. In one example, tickets may be associated with a particular player, and the player may be awarded loyalty points or other credit for playing the game.

Taking a slot machine game, a player is issued a ticket at a POS to play one or more instances of the slot machine game. The ticket indicates an access code, and the player uses this access code to gain access to the system (e.g., from a host coupled to server 503 through the Internet). The player enters the access code in a user interface, and, once validated, is permitted to play the online portion of the slot machine game. In one example, the slot machine game includes one or more reels (e.g. reels 602) having symbols (e.g., symbol 605) arranged in one or more rows (e.g., rows 603). The results of the offline portion of the game may be presented within the online portion of the game to the player. As the player spins the slot machine, one or more online results are presented to the player. In another embodiment of the present invention, a slot machine game is played in an online/offline format. In one example using a scratch-type ticket (or card) having a slot machine representation printed on the ticket, one or more scratchable or other type of printed areas are provided to the player for playing the offline portion of the game. These scratchable areas may be located in one or more slot locations presented on one or more reels of the slot machine representation. The player scratches one or more of the areas to reveal symbols printed on the ticket. These symbols may, when arranged in particular groups along pay lines of the slot machine, may provide a winning outcome. According to one embodiment of the present invention, one or more of the areas (e.g., slot locations) may not be revealed in the offline portion of the game. Rather, the player must play an online portion of the game to reveal the missing outcomes.

Figure 6:
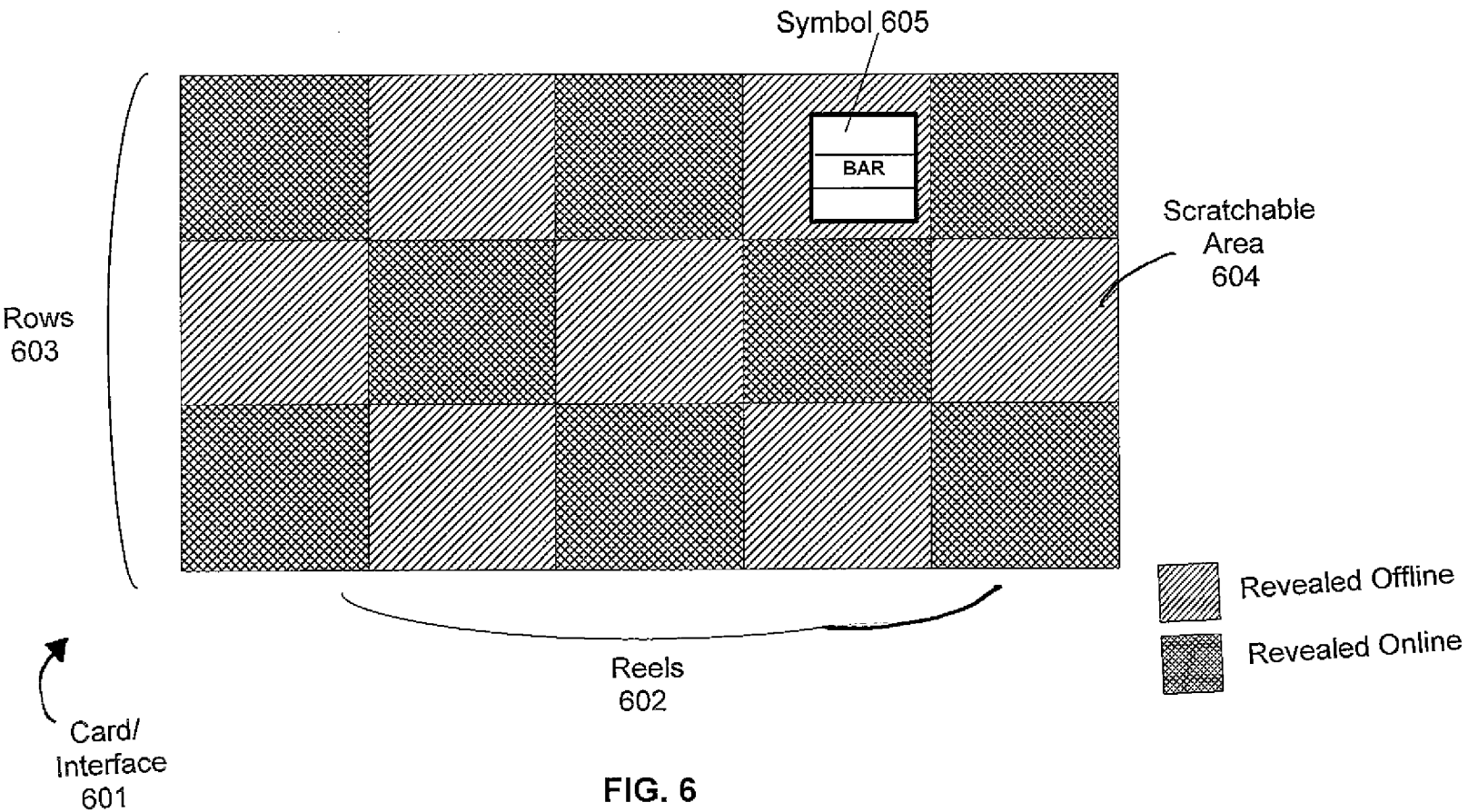
FIG. 6 is an example game interface according to one embodiment of the present invention.

FIG. 6 shows one example interface 601 of a slot machine game according to one embodiment of the present invention. Interface 601 may include some elements that are shown on a game ticket, and other elements that are shown in an online portion of the game. One specific example of a slot machine game may include one or more of the following features, alone or in combination, as follows:

A scratch-type card (e.g., card/interface 601) is provided as shown in FIG. 6 having a printed 3.times.5 grid, representing a five-reel (e.g., reels 602), three-row (e.g., rows 603) slot machine.

In the slot machine representation, there is a checkerboard of seven (7) scratchable areas (e.g., scratchable area 604 such as a tile).

The scratchable areas can be scratched to reveal symbols (e.g., symbols 605) printed on the card.

The remaining eight (8) tiles of the checkerboard are revealed in an online portion of the game. For instance, a player, playing an online game over the Internet, may play the online portion of the game. In one example, the player may reveal the remaining areas over one or more plays of the online game. For instance, the eight (8) remaining areas may be revealed over successive "spins" of an online slot machine.

According to one embodiment, the online portion of the game includes a graphic representation of the card (e.g., card/interface 601) used for the offline portion of the game. In one specific example, the online version of the card displays the results received in the offline portion of the game. For example, in the case of the slot machine described above, the seven scratchable area results are displayed as results in the online game interface.

In one example, matches can be made on one or more (e.g., nine (9)) pay lines.

There can also be one or more (e.g., five (5)) special scratch areas on the card which represent a "bonus" pattern. If a player matches that pattern in any of the pay lines (e.g., any of the nine pay lines), that player wins a bonus prize.

In another embodiment of the present invention, a bingo game is played in an online/offline format. In one example using a scratch-type ticket (or card) having a bingo game representation printed on the ticket, one or more scratchable areas are provided to the player for playing the offline portion of the game. In one embodiment, the bingo game is the well-known American bingo game format. However, it should be appreciated that any bingo game having any type of card or format may be used.

These scratchable areas may be located in one or more locations on one or more bingo cards. The player scratches one or more of the areas to reveal symbols printed on the ticket. These symbols may, when arranged in particular patterns on a bingo card, may provide a winning outcome.

According to one embodiment of the present invention, one or more of the areas (e.g., bingo card numbers) may not be revealed in the offline portion of the game. Rather, the player must play an online portion of the game to reveal the missing outcomes. In another example, all of the card numbers of one or more bingo cards are revealed in the offline portion of the game, and the player plays the online portion of the game to receive the called numbers, yielding the outcome of one or more bingo cards.

Figure 7:
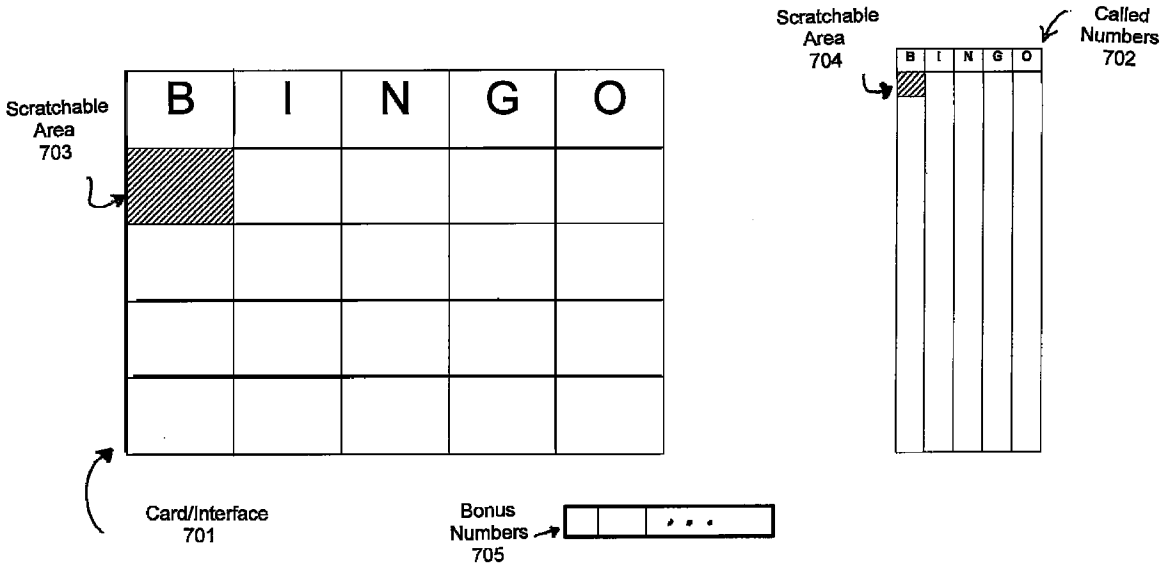
FIG. 7 is another example game interface according to one embodiment of the present invention.

FIG. 7 shows one example interface 701 of a bingo game according to one embodiment of the present invention. Interface 701 may include some elements that are shown on a game ticket, and other elements that are shown in an online portion of the game. One specific example of a bingo game may include one or more of the following features, alone or in combination, as follows:

A large card is printed with one or more standard American-type bingo cards (e.g., card/interface 701) as shown in FIG. 7. In one example, the card and its corresponding spaces are large enough to daub with a marker.

The player scratches off spaces (e.g., scratchable area 703) on the cards to reveal his/her card numbers.

The player plays an online portion of the game where bingo numbers are "called" by a game program, and the player is provided a win/loss indication for each of the respective cards. For instance, in a game where a player is not playing against other players, a finite number of balls may be called. If the player does not have a winning pattern after the last ball is called, the player does not win a prize.

Alternatively or in combination, the card provided to the player includes scratchable areas on the cards (e.g., area 703) as well as in a called numbers section (e.g., area 704 in called numbers section 702).

According to one embodiment, the online portion of the game includes a graphic representation of the card (e.g., card/interface 701) used for the offline portion of the game. In one specific example, the online version of the card displays the results received in the offline portion of the game. For example, in the case of the bingo game described above, the scratchable areas of the bingo card (the assigned numbers of the bingo card) are displayed as results in the online game interface.

Prizes are distributed via win patterns. In one example, one particular win pattern corresponds to a single prize. A bingo win pattern may include, for example, four corners, five in a row, etc. There may be any number and type of win patterns. Win patterns may be identified in a pay table with their corresponding prizes. More difficult patterns (e.g., a pattern covering all of the card entries) may be associated with larger prizes.

In one example, a physical card has one or more (e.g., five (5)) bonus numbers 705 that can be revealed by scratching off a coating in the offline portion of the game. If one or more of the player's bonus numbers are included in the win pattern, the player is awarded a bonus prize. That is, the bonus number may act as a multiplier to increase an awarded prize.

Figure 8:
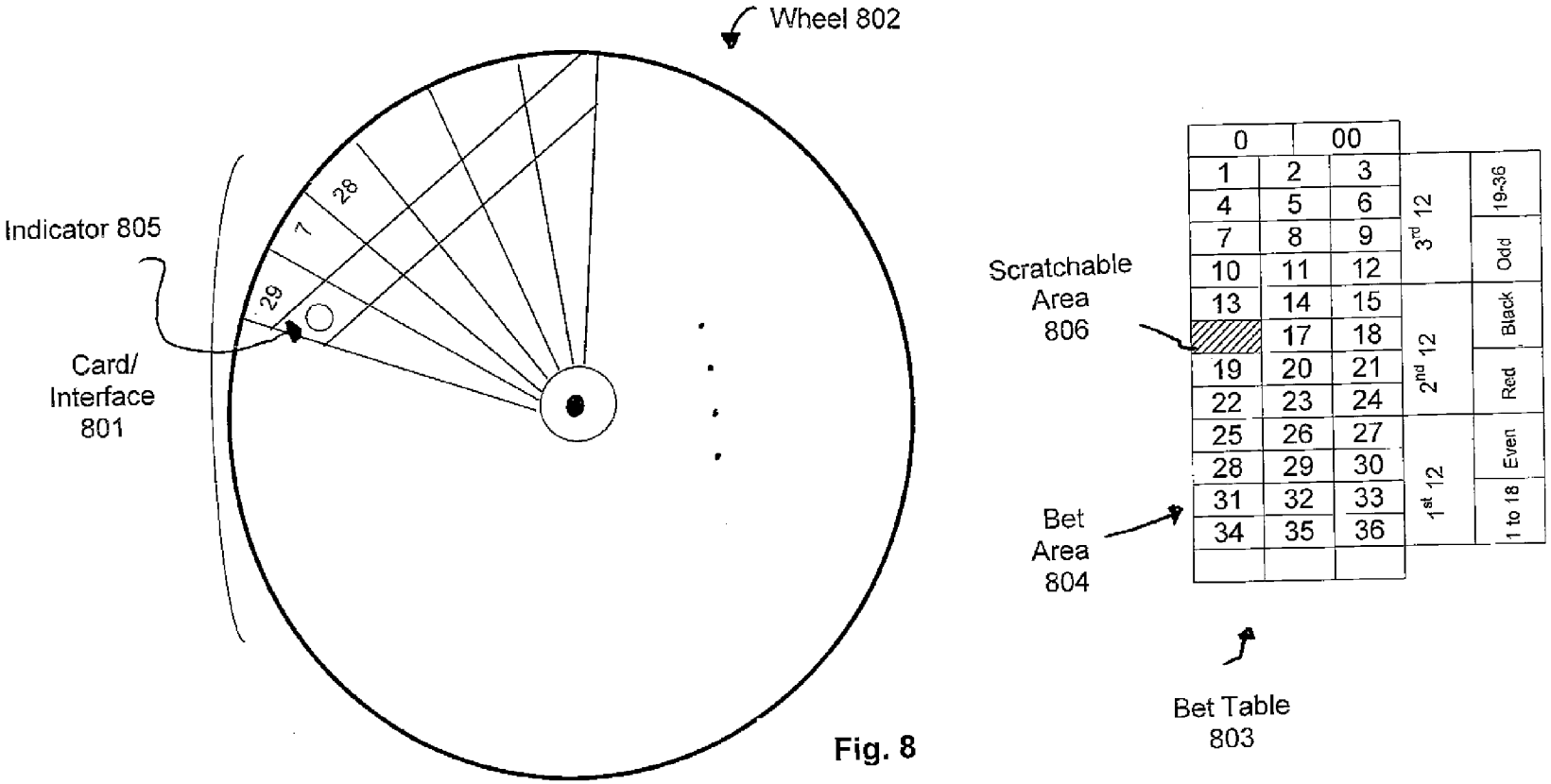
FIG. 8 is another example game interface according to one embodiment of the present invention.

In another embodiment of the present invention, a roulette game is played in an online/offline format. In one example using a scratch-type ticket (or card) having a roulette game representation printed on the ticket as shown in FIG. 8, one or more scratchable areas (e.g., area 806) are provided to the player for playing the offline portion of the game. In one embodiment, the card (e.g., card/interface 801) includes a representation of a casino-style roulette wheel (e.g., wheel 802) printed on the card. Further, the card includes a bet table (e.g., bet table 803) printed thereon.

These scratchable areas may be located in one or more locations on the roulette wheel representation and/or bet table. The player scratches one or more of the areas to reveal bets in bet areas (e.g., bet area 804) on the bet table or the roulette wheel outcome (e.g., indicated by indicator 805 selecting the number 29 outcome) printed on the ticket.

According to one embodiment of the present invention, one or more of the areas (e.g., the roulette wheel outcome) may not be revealed in the offline portion of the game. Rather, the player must play an online portion of the game to reveal the missing outcomes. In another example, bets on the bet table are revealed in the offline portion of the game, and the player plays the online portion of the game to receive the result of the spin of the roulette wheel, yielding the outcome of the individual bets. In another example, the printed card may have more than one bet table, each of which corresponds to a spin of a roulette wheel made in an online portion of the game. To this end, an online game may have a control that a player may select to cause the roulette wheel to spin and display the outcome of the spin.

According to another aspect of the present invention, a first game is played offline, and a second game is played online, both the first and second games being associated with the same ticket. For instance, this same ticket may permit a player to play a complete game offline, and play a separate game online. These first and second games, for example, may have independent outcomes. These games may, however, be the same or similar types of games (e.g., a slot machine game), same themes, etc. among the first and second games.

In another aspect of the present invention, standard offline games (e.g., scratch-based, pull-tab, printed lottery, bingo, keno, etc.) may be combined with an online game component. This is beneficial, as the interest in standard offline games may be increased by providing an additional online game component. For example, standard offline games may become "online" enabled by the payment of an additional fee. In one specific example, offline games are made online compatible at the point of ticket issuance (e.g., at a POS). For instance, a retailer may, upon payment of an additional fee, enable a ticket associated with an offline game to become online enabled. This may be accomplished, for example, at the POS by scanning or otherwise inputting a ticket identifier of an issued ticket and enabling an online game associated with the issued ticket. Other aspects of the game may be revealed online, such as, for example, a prize multiplier that is used to determine an ultimate prize awarded to the player. It should be appreciated that other features may be used with such an online/offline format, and the invention is not limited to any particular format unless specifically recited in the claims.

Having thus described several aspects of at least one embodiment of this invention, it is to be appreciated that various alterations, modifications and improvements will readily occur to those skilled in the art. Such alterations, modifications, and improvements are intended to be part of this disclosure, and are intended to be within the spirit and scope of the invention. Accordingly, the foregoing description is by way of example only.

What is claimed is

1. A method for administering a game of chance, the method comprising acts of:

providing for a player to purchase, at a point of sale (POS), an entry into a wagering game of chance, the entry in the wagering game of chance being represented by a ticket the game of chance associated with at least one partial outcome and a final outcome:

issuing the ticket to the player, the ticket including an offline game, wherein play of the offline game reveals the partial outcome to the player, the partial outcome separate from the final outcome; and providing for the player to play an online game including a set of elements, the online game of a different type than the offline game the set of elements revealed to the player on a medium independent from the ticket, wherein play of the online game reveals the final outcome.

2. The method according to claim 1, wherein the offline game is a separate game from the online game.

3. The method according to claim 1, wherein the online game and offline game have separate respective outcomes.

4. The method according to claim 1, wherein the offline game is at least one of a scratch-type, pull-tab, lottery, bingo, or and keno games.

5. The method according to claim 1, further comprising an act of associating the online game with the offline game.

6. The method according to claim 4, wherein the method further comprises an act of associating the at least one of the scratch-type, pull -tab, lottery, bingo, or and keno games with the online game.

7. The method according to claim 5, wherein the act of associating is performed at a point of sale (POS).

8. The method according to claim 7, wherein the act of associating further comprises an act of associating the issued ticket with the online game.

* * * * *